United States Patent [19]

Nishimoto

[11] 4,316,664

[45] Feb. 23, 1982

[54] CONVEYANCE SYSTEM INCORPORATED IN PHOTOGRAPHIC TREATMENT APPARATUS FOR LONG LENGTH PHOTOSENSITIVE MATERIAL

[75] Inventor: Kanichi Nishimoto, Wakayama, Japan

[73] Assignee: Noritsu Koki Co., Ltd., Wakayama, Japan

[21] Appl. No.: 116,242

[22] Filed: Jan. 28, 1980

[30] Foreign Application Priority Data

Feb. 2, 1979 [JP] Japan ..... 54-10302

[51] Int. Cl.[3] ..... G03D 3/13

[52] U.S. Cl. ..... 354/321; 354/338; 226/88; 226/196

[58] Field of Search ..... 354/313, 314, 316, 319, 354/320, 321, 322, 338, 339; 226/88, 196; 242/76; 352/228

[56] References Cited

U.S. PATENT DOCUMENTS

| | | | |
|---|---|---|---|
| 2,186,927 | 1/1940 | Hughey | 354/338 |
| 2,897,719 | 8/1959 | Tiller | 352/228 |
| 2,981,146 | 4/1961 | Kipping | 352/228 |
| 2,996,951 | 8/1961 | Debrie | 352/228 |
| 3,372,849 | 3/1968 | Hall et al. | 226/88 |
| 3,523,498 | 8/1970 | Phelps | 354/321 |
| 3,712,206 | 1/1973 | Schmidt | 354/322 |
| 3,769,897 | 11/1973 | Zwettler et al. | 354/322 |
| 4,055,289 | 10/1977 | Kaiser et al. | 226/88 |
| 4,071,294 | 1/1978 | Scibilia | 352/228 |

FOREIGN PATENT DOCUMENTS

| | | | |
|---|---|---|---|
| 2246834 | 3/1974 | Fed. Rep. of Germany | 354/339 |

*Primary Examiner*—L. T. Hix
*Assistant Examiner*—Alan Mathews
*Attorney, Agent, or Firm*—William E. Jackson

[57] ABSTRACT

A conveyance system incorporated in photographic treatment equipment or apparatus in which various photographic treatments are performed for an exposed but undeveloped long length photosensitive material comprising a conveyance passage which is formed with guiding grooves, through which the travelling photosensitive material is conveyed forward with its edges on both sides fit into said guiding grooves, a group of conveyance members having a distance shorter than the length of the travelling photosensitive material and protruding into the both guiding grooves of the conveyance passage so as to clamp the travelling photosensitive material at its edges on both sides, and photosensitive material curving members located along the central position between both guiding grooves so as to ensure increased resistibility against longitudinal warping of the travelling photosensitive material by pressing the same along the central position thereof and positively bending it to a certain circular arch with the aid of the aforesaid guiding grooves.

6 Claims, 3 Drawing Figures

CONVEYANCE SYSTEM INCORPORATED IN PHOTOGRAPHIC TREATMENT APPARATUS FOR LONG LENGTH PHOTOSENSITIVE MATERIAL

BACKGROUND OF THE INVENTION

1. Field of the Invention

The present invention relates to a conveyance system incorporated in various photographic treatment apparatuses for an exposed but undeveloped photosensitive material, and particularly to an improved conveyance system suitably incorporated in an automatic developing apparatus in which a series of developing steps comprising developing, bleaching, fixing, stabilizing, hardening, and others, accompanied by water washing interposed between any two steps as required, and processing steps for drying as required, are performed for the exposed long-length photosensitive material such as photographic printing paper which is originally in a form of a roll and is comparatively wide, but has a tendency of losing its rigidity against warping as it becomes wet with treatment liquid.

2. Description of the Prior Art

Until this time, a variety of photographic treatment equipment and apparatus for photosensitive material with conveyance systems incorporated therein have already been developed and some have been put to practical use, wherein said photographic treatment equipment and apparatus are constructed such that a series of photographic treatments such as developing treatments comprising developing, bleaching, fixing, stabilizing, hardening and others are performed not only for a long length photosensitive material but also for short photosensitive sheet material, accompanied by water washing interposed between any two treatment steps as required, and drying subsequently carried out therefor, while the photosensitive material to be treated is guided by means of a guide member with guiding grooves formed at both side edges thereof without the necessity for a leader, trailer or conveyance belt means.

However, the disadvantages of the conventional conveyance system incorporated in the photographic treatment equipment or apparatus are, that due to the arrangement of a number of conveyance rollers throughout the conveyance passage with guiding grooves formed at both side edges thereof for the travelling photosensitive material and due to any minor relative speed difference between the respective conveyance rollers as well as between any one of the conveyance rollers and auxiliary roller disposed in the guide-in portion to the guide groove, the guide-out portion from said guide groove or the conveyance direction changing section tends to cause undesirable wrinkles or injured traces on the travelling photographic printing paper, while developing treatment is performed for the travelling printing paper, because this kind of long length photographic printing paper is in a form of a roll and is comparatively wide, but has a tendency of losing its ridigity against longitudinal warping as it is conveyed through the photographic treatment equipment or apparatus and gets wet with treatment liquid. In the worst case, the traveling photographic printing tears. Thus it is natural that the need for eliminating the aforesaid disadvantages of conventional photographic treatment equipment and improving its operational performance is increasingly voiced by many operators of conventional photographic treatment equipment.

Lately it has been suggested that as manufacturers of photographic treatment equipment, we should be ready to substantially increase operational efficiency of this equipment, in response to the recent widespread use of cameras.

BRIEF SUMMARY OF THE INVENTION

The present invention is concerned with a new and unique technique which has been developed to eliminate the above mentioned disadvantages with conventional conveyance systems incorporated in photographic treatment equipment or apparatus for long length photosensitive materials such as long length photographic printing papers which are comparatively wide, but have a tendency of losing their rigidity against longitudinal warping as they get wet with treating liquid. The conveyance system in the present invention is intended to be incorporated in photographic treatment equipment or apparatus such as automatic developing apparatus in which various photographic treating steps such as developing, bleaching, fixing, stabilizing, hardening or the like are performed for the unrolled long length photosensitive material, accompanied by water washing, drying, or other processes interposed between any two steps as required and comprises a conveyance passage which is formed with guiding grooves along both side edges thereof, through which the travelling photosensitive material is conveyed with both its side edges through which the travelling photosensitive material is conveyed with both its side edges held in said guiding grooves, a group of conveyance members having a length shorter than the length of the travelling photosensitive material and protruding into both guiding grooves of said conveyance passage so as to clamp the travelling photosensitive material at both its side edges, and photosensitive material curving members located along the central position between the both guiding grooves so as to ensure increased resistibility against longitudinal warping of the travelling photosensitive material by means of pressing the same along the central position thereof and positively bending it to a certain circular arch with the aid of both guiding grooves.

It is a major object of the present invention to provide a conveyance system in which undesirable natural longitudinal warping is effectively prevented by a curving means in conjunction with the guiding grooves through which a long length photosensitive material such as photographic printing paper, wider than commercial 35 mm width roll film, is conveyed with both its side edges held therein or by means of a series of curving rollers which are arranged in a longitudinal alignment so as to prevent the aforesaid longitudinal natural warping of the travelling photosensitive material, said longitudinal natural warping being caused as the travelling photosensitive material is conveyed through the respective photographic treatment apparatuses in which a series of photographic treatment such as developing, bleaching, fixing, stabilizing, hardening or the like is performed and thereby gets wet with photographic treatment liquid, and whereby arrangement of a number of conventional conveyance rollers roller or auxiliary guiding rollers is substantially reduced, said conventional conveyance rollers or auxiliary guide rollers being located throughout the conveyance passage, resulting in operational troubles, reduced operational efficiency and substantially reduced commodity value.

It is another major object of the present invention to provide a conveyance system in which other long length photosensitive material which are substantially the same as the long length photographic printing paper mentioned above can be used without any difference in operational effectiveness.

It is another object of the present invention to provide a conveyance system which is applicable not only for developing equipment and apparatus but for other miscellaneous treatment equipment and apparatus such as dryers for all kinds of long length photosensitive material.

It is still another object of the present invention to provide a conveyance system which is simple in structure and inexpensive to manufacture.

It is yet another object of the present invention to provide a conveyance system in which there is no possibility of producing wrinkles, injured traces or the like on any long length photosensitive material including the long length photographic printing paper as mentioned above, where the conveyance system is incorporated in any photographic treatment equipment or apparatus in which various developing steps are performed therefor.

It is still another object of the present invention to provide a conveyance system which ensures the smooth flowing of treatment liquid in the respective treatment batches, hot air for drying operation in a drier or the like, where the conveyance system is incorporated in the photographic equipment or apparatus as mentioned above.

The above and other objects and features of the invention will be apparent from a reading of the following description of the disclosure found in the accompanying drawings, and the novelty thereof pointed out in the appended claims.

BRIEF DESCRIPTION OF THE ACCOMPANYING DRAWINGS

The accompanying drawings illustrate a preferred embodiment of the present invention, in which a conveyance system for long length photosensitive sheet material in photographic material treatment equipment is arranged on a rack for a developing apparatus in which developing operation is performed for a strip of photographic printing paper which is substantially wider than conventional 35 mm width photosensitive roll film and particularly tends to warp increasingly as it passes therethrough and gets wet with developer liquid.

DETAILED DESCRIPTION OF THE PREFERRED EMBODIMENT

Figure 1:
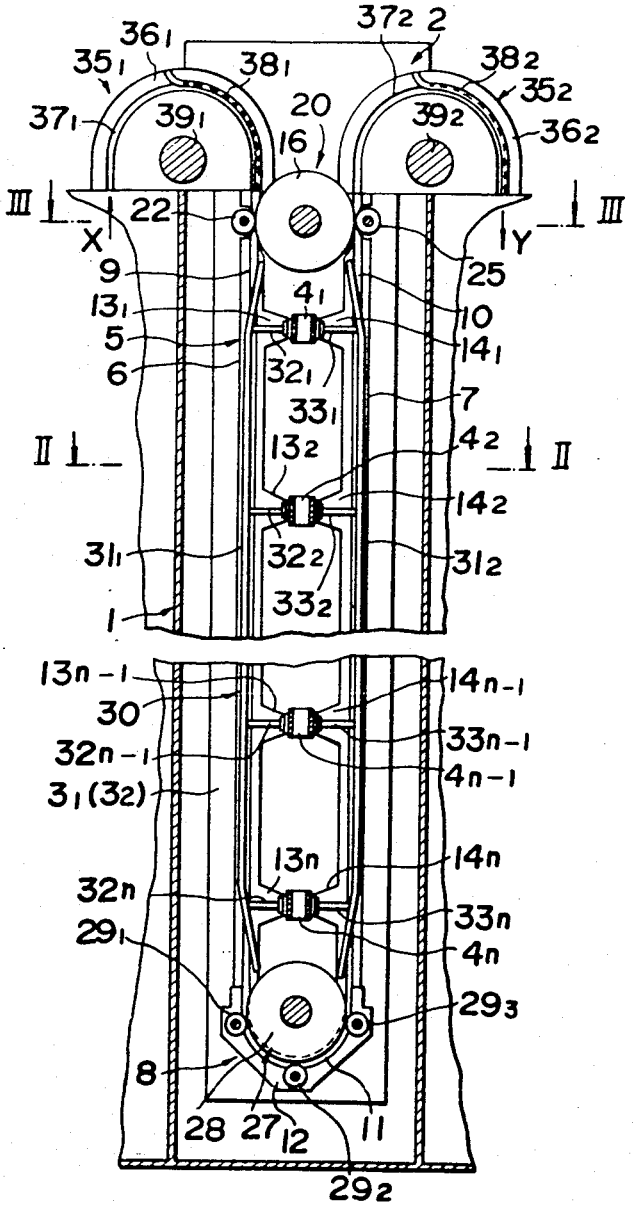
FIG. 1 is a vertical sectional view of a part of a treatment bath, vertically sectioned along a plane which is vertically extended at the central portion of the aforesaid automatic developing apparatus, wherein insignificant parts and components in the conveyance system are neglected for the purpose of simplification of illustration.

FIG. 1 illustrates typically one of treatment baths, each of which is constructed in substantially the same configuration and arranged one after another in the automatic developing apparatus in which a series of developing treatments comprising treating steps such as developing, bleaching, fixing, stabilizing, hardening, etc., is performed for a strip of unrolled photographic printing paper P (not shown in FIG. 1), accompanied by water washing interposed between any two steps of the aforesaid treating steps, if necessary, said photographic printing paper being substantially wider than conventional 35 mm width roll films in popular use and having a tendency to warp increasingly as it gets wet with developing liquid. In the respective treatment baths into which a variety of treatment liquids and water are to be supplied in accordance with the specified order of treatment steps for the long length photographic printing paper P, a rack 2 is provided with the conveyance system (to be described in more detail later) which is intended for conveying the long length photographic printing paper P. Between the upper portions of the respective adjacent treatment baths are arranged photographic printing paper transfer members $\mathbf{35}_1$ and $\mathbf{35}_2$ for the approaching photographic printing paper P, said photographic printing paper transfer members $\mathbf{35}_1$ and $\mathbf{35}_2$ being detachably incorporated into the aforesaid rack 2. It is to be noted that said photographic printing paper transfer members will be briefly described later, although they are well known in structure. Further on the front wall of the foremost treatment bath is located a guide in member which is intended for guiding the travelling printed paper P into the aforesaid foremost treatment bath, while on the rear wall of the last treatment bath is located a guide-out member which is intended for smoothly taking out the finally treated printing paper P, said guide-in and guide-out members being also detachably incorporated into the rack 2. These guide-in and guide-out members are designed and constructed in the same manner as the hitherto known automatic developing apparatuses and thus their detailed illustration and decription have been neglected for the purpose of simplification.

The rack 2 immersed in the respective treatment baths is constructed such that it is provided with U-shaped rail 5 (to be described in more detail later) for preparing the conveyance passage for the travelling printing paper P along both longitudinal side edges thereof between the channel-shaped main frames $\mathbf{3}_1$ and $\mathbf{3}_2$, a take-in and take-out member 20 (to be described in more detail later) which serves to convey the travelling printing paper P along said guide rail 5 and take it therefrom, a U-shaped turn member 27 (to be described in more detail later) which serves to carry out smooth U-shaped turning for the travelling printing paper P along the U-shaped portion at the lower end of the guide rail 5, and printing paper curving members 30 (to be described in more detail later) which form a significant characteristic part of the invention. In this connection it is to be added that said channel-shaped main frames $\mathbf{3}_1$ and $\mathbf{3}_2$ are located opposite each other and integrally assembled by means of a plurality of connecting rods (not shown) and support members $\mathbf{4}_1, \mathbf{4}_2 \ldots \mathbf{4}_n$, the latter being constructed in substantially the same configuration and disposed at a substantially constant distance in the vertical direction, and that said printing paper curving member 30 is intended to ensure resistibility against longitudinal warping of the travelling printing paper P, said longitudinal warping being caused due to reduced rigidity thereof, as it is guided along the straight guide section 6 or 7 of the guide rail 5, being subjected to the predetermined developing treatment, whereby it gets wet with the developer liquid.

Figure 2:
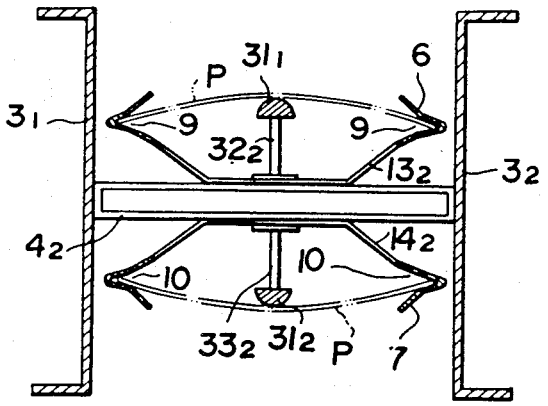
FIG. 2 is a cross-sectional view of the conveyance system, taken in line II—II in FIG. 1 and seen from above in the direction indicated with arrow marks.
Figure 3:
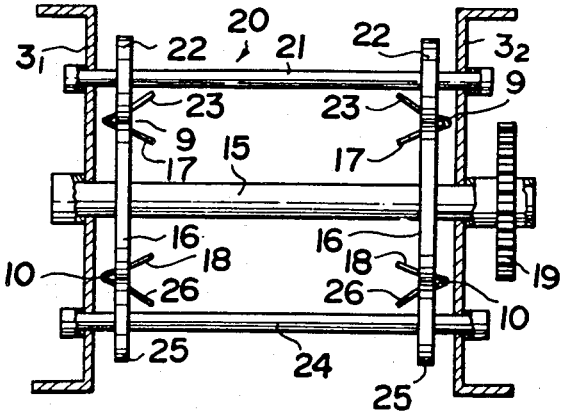
FIG. 3 is another cross-sectional view of the conveyance system, taken in line III—III in FIG. 1 and seen from above in the direction indicated with arrow marks.

As apparent from FIG. 2 and 3, the guide rail 5 is constructed of two straight guide sections 6 and 7 and conveyance direction changing guide section 8. The straight guide sections 6 and 7 are prepared in such a manner that two long length sheet metal materials are subjected to bending operation at their edge portions so as to form V-shaped guide grooves 9 and 9, 10 and 10, along which the both edges of the travelling printing paper P are adapted to be guided, whereby

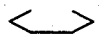

shaped cross-section is produced, and then the substantial part of the sheet metal materials are cut away so as to provide passages through which treatment liquid flows in and out or circulates, whereas the residual parts of the sheet metal materials serve as mounting feet $13_1$, $13_2 \ldots 13_n$ and $14_1$, $14_2 \ldots 14_n$ and are fastened to the support members $4_1$, $4_2 \ldots 4_n$ on the opposite sides thereof so that the straight guide sections 6 and 7 are prepared. The conveyance direction changing guide section 8 is prepared in such a manner that the plate members 12 and 12 (front side thereof not shown) are connected via spacers (now shown), said plate members 12 and 12 being provided with the V-shaped guiding grooves 11 and 11 (front side thereof not shown) in the half-circular form, which are jointed to the guiding grooves 9 and 9, and 10 and 10 at the lower end portions of the straight guide sections 6 and 7 of the guide rail 5, whereby the conveyance direction changing guide section 8 is provided for ensuring smooth U-shaped turning of the travelling printing paper P.

The take-in and take-out members 20 are constructed of a main take-in and take-out roller 15 and auxiliary follower rollers 21 and 24, said main take-in and take-out roller 15 being such that both large diameter portions 16 and 16 protrude into the respective cut-away potions 17 and 17, and 18 and 18 at the upper parts of both guiding grooves 9 and 9 of the straight guide section 6 and of both guiding grooves 10 and 10 of the straight guide section 7 of the guide rail 5, their shaft rotatably supported by means of the bearings (not shown) in the both main frames $3_1$ and $3_2$ and as illustrated in FIG. 3, one extension end of said shaft having a sprocket 19 securely mounted thereon so as to conduct driving power thereto, while said auxiliary follower rollers 21 and 24 being such that both large diameter portions 22 and 22, 25 and 25 protrude into the respective cut-away portions 23 and 23, 26 and 26 at the upper parts of the both guiding grooves 9 and 9, and 10 and 10, so that they are energized to clamp the travelling printing paper P in cooperation with said large diameter portions 16 and 16 of the main roller 15.

Next, the U-shaped turn member 27 is intended to ensure smooth U-shaped turning of the travelling printing paper P in cooperation with the guiding grooves 11 and 11 (front side thereof not shown) in a pair of plate members 12 and 12 (front side thereof not shown) for the aforesaid conveyance direction changing guide portion 8. Particularly, said U-shaped turn member 27 is constructed of a main driving U-shaped turn roller 28 which serves for the U-shaped turn of the travelling printing paper P, and auxiliary rollers $29_1$, $29_2$ and $29_3$, having substantially the same configuration as that of the aforesaid auxiliary follower rollers 21 and 24 and being energized to clamp the travelling printing paper P at their large diameter portions in cooperation with said U-shaped turn conveyance rollers 28 on both sides thereof.

Now the aforesaid printing paper curving members 30 will be described, which form an advantageous and characteristic part of the present invention. The printing paper curving members 30 are designed and constructed for the purpose of ensuring increased resistibility against longitudinal warping of the travelling printing paper P with the aid of the guiding grooves 9 and 9, and 10 and 10 without any danger of injuring the emulsion coated surface of the printing paper P, said longitudinal warping being naturally caused due to reduced rigidity of the travelling printing paper P, as it passes through the treatment bath and thereby gets wet with treatment liquid. Particularly the printing paper curving members 30 essentially comprise a bow-shaped longitudinally extending member 31, located substantially along the central line between both the guiding grooves 9 and 9 over the straight guide section 6 of the guide rail 5 on one side of the rack 2 and another bow-shaped longitudinally extending member $31_2$, located substantially along the center line between both the guiding grooves 10 and 10 over the straight guide section 7 of the guide rail 5, said bow-shaped longitudinally extending member $31_1$ being located between the guiding grooves 9 and 9 in the straight guide section 6 at the upper and lower end portions thereof in the vicinity of the main roller 15 and main guide rollers 28, with other large part thereof protruding outwards beyond a plane extending across the guiding grooves 9 and 9 and fastened to the support members $4_1$, $4_2 \ldots 4_n$ at the bottom portion thereof with the aid of stays $32_1$, $32_2 \ldots 32_n$ arranged therebetween, while said bow-shaped longitudinally extending member $31_2$ being located between the guiding grooves 10 and 10 in the straight guide section 7 at the upper and lower end portion thereof, with other substantial part thereof protruding outwards beyond a plane extending through both the guiding grooves 10 and 10 and fastened to the support members $4_1$, $4_2 \ldots 4_n$ at the bottom portion thereof with the aid of another stays $33_1$, $33_2 \ldots 33_n$ arranged therebetween. Thus it follows that the aforesaid bow-shaped longitudinally extending members $31_1$ and $31_2$ are located in a symmetrically opposite arrangement.

Further, a pair of plate member $36_1$ and $36_1$ (front side thereof not shown) and $36_1$ and $36_2$ (front side thereof not shown) are integrally assembled with the aid of the distance pieces $39_1$ and $39_2$ extended therebetween, said plate members $36_1$ and $36_1$, $36_2$ and $36_2$ being provided with guiding grooves $37_1$ and $37_2$ having a V-shaped sectional configuration respectively as well as guiding rods $38_1$ and $38_2$. In this connection it is to be added that said plate members $36_1$ and $36_2$ are constructed in the same manner as the aforesaid printing paper transfer member $35_1$ and $35_2$ which are mounted over the two adjacent treatment baths and are intended to ensure smooth transference of the travelling printing paper P from the aforesaid rack in the preceding treatment bath to the next rack in the following treatment bath and that said V-shaped guiding grooves $37_1$ and $37_2$ are constructed in such a manner as to make continuous connection between the tail end portions of both the guiding grooves (same structure as the aforesaid guiding grooves 10 and 10) of the guide rail (same structure as the aforesaid guide rail 5) in the rack (same structure as the aforesaid rack 2) in the preceding treatment bath and the starting end portions of both the guiding grooves (same structure as the aforesaid guiding grooves 9 and 9) in the rack (same structure as the aforesaid rack 2) in the following treatment bath.

Now operation of the conveying system in accordance with the present invention will be described as follows.

As described above, the rack into which the conveyance system in accordance with the present invention is incorporated for conveying the long length photographic printing paper P is immersed in the respective treatment baths, each of which is arranged one after another so that the exposed printing paper P passes therethrough so as to carry out the development operation in the automatic developing apparatus, while said printing paper P is fed in. First the leading end of the long length photographic printing paper P, conveyed from the preceding treatment bath in the direction as indicated with the arrow mark X in FIG. 1, moves toward the guiding grooves 9 and 9 on both sides of straight guide section 6 of the guide rail 5, being guided along the both side edges by means of the guiding grooves $37_1$ and $37_1$ (front side thereof not shown) and the guiding rods $38_1$ and $38_1$ (front side thereof not shown) in the printing paper transfer member 35. Then the travelling printing paper P is clamped between the large diameter driving portions 16 and 16 of the take-in and take-out main roller 15 and the large diameter driven portions 22 and 22 of the auxiliary roller 21 in the take-in and take-out member 20 and driven thereby so as to convey the travelling printing paper through the treatment liquid in the treatment bath 1 in the downward direction, while it is guided along the guiding grooves 9 and 9. As the travelling printing paper P is further driven, the reverse face of said printing paper P where no emulsion coating is prepared engages against the bow-shaped longitudinally extending member $31_1$ on one side of the printing paper curving member 30, the travelling printing paper P deforming to a circular arc in excess of or against longitudinal natural warping thereof which is caused as it gets wet with treatment liquid, recognizable by a sectional view taken at a right angle to the forward direction of the printing paper P.

In fact the long length photographic printing paper P has become very resistant to any longitudinal warping due to the forcible curving imparted to the printing paper P as described above, whereby it is ensured that the travelling printing paper P is guided and conveyed downwards through the treatment liquid in the treatment bath 1 only with the aid of the guiding grooves 9 and 9, without any arrangement of a number of conveying and guiding rollers and other auxiliary members required as is the case with conventional automatic developing apparatus.

Then the aforesaid forced curving of the travelling printing paper P is gradually released as it approaches the conveyance direction changing section 8. In this conveyance direction changing section 8 the travelling printing paper P carrys out U-shaped turning operation in cooperation with the main guide roller 28, the auxiliary rollers $29_1$, $29_2$ and $29_3$ and others, all of which are conventionally available for U-shaped turning operation, so that the travelling printing paper P is smoothly and correctly advanced toward the straight guide section 7 on the other side of the rack 2.

As the travelling printing paper P is further conveyed toward the straight guide section 7 of the guide rail 5, it is forcibly deformed by means of the other bow-shaped longitudinally extending member $31_2$ in the same manner as described above, and then conveyed upwards through the treatment liquid in the the treatment bath 1 without any hindrance encountered, being guided only with the aid of the guiding grooves 10 and 10. The forced curving of the travelling printing paper P is gradually released, as it approaches the main guide-in and guide-out roller 15, and at the same time it is clamped between the large diameter driving portions 16 and 16 of said main roller 15 and the large diameter driven portions 25 and 25 of the auxiliary roller 24 and then driven thereby toward the printing paper transfer member $38_2$. Then the travelling printing paper P is delivered via said printing paper transfer member $35_2$ to the rack (having the same structure as the aforesaid rack 2) in the next treatment bath in the direction as indicated by the arrow mark "Y."

As far as the aforesaid guide rail 5 is concerned, it is obvious that there could be many modifications or alterations. The guide rail 5 may be such that it is prepared by way of the steps of bending a strip of sheet metal to a V-shaped configuration substantially along its longitudinal center line in such a manner that the both bent portions are located opposite to each other and then allowing one side thereof to have mounting feet thereon which are adapted to be connected to the support members $4_1$, $4_2$ . . . $4_n$. Alternatively the rack 2 may be eliminated and in place of the aforesaid main frames $3_1$ and $3_2$ of the rack 2 a plurality of guiding grooves equivalent to the aforesaid guiding grooves 9 and 9, 10 and 10, 11 and 11 may be secured directly on the both side walls in the respective treatment baths. Further a plurality of guide rail segments may be individually arranged, which are provided with guiding grooves respectively. Furthermore main guide-in and guide-out rollers, main U-turn roller and auxiliary rollers in cooperation with them, which are equivalent to the aforesaid main guide-in and guide-out roller 15, main U-turn roller 28 and auxiliary rollers 21, 24, $29_1$ . . . in cooperation with them may be directly supported on the both opposite side walls of the respective treatment baths.

Moreover the aforesaid bow-shaped longitudinally extending rods $31_1$ and $32_2$ of the printing paper curving member 30 may be arranged in a different manner with respect to the straight guide sections 6 and 7 of the guide rail 5 so that the orientation of curving of the travelling printing paper P is opposite to that as illustrated in FIG. 2. In some cases the aforesaid bow-shaped longitudinally extending rods $31_1$ and $31_2$ may be replaced with roller means which have less frictional resistance than that of said bow-shaped members to serve as printing paper curving members. It is noted that the last mentioned case is preferable, because the roller means have less frictional resistance and thus have no adverse effect on the emulsion coated surface of the long length photographic printing paper, even when the rollers are brought in contact with the emulsion coated surface of the printing paper.

It should be understood by those skilled in the art that the foregoing description is merely a preferred embodiment of the disclosed system in accordance with the present invention and that a variety of changes and modifications may be made in the present invention without any departure from the spirit and scope thereof.

Further it is obvious that the disclosed conveyance system intended for developing treatment of long length photographic printing materials may be applicable to a drier or the like which is arranged for the developed printing materials.

As apparent from the foregoing description, the present invention is concerned with a conveyance system for long length photosensitive materials, which is preferably incorporated in treatment equipment or apparatus such as automatic developing apparatus, drier etc. and has a number of advantageous features in that the conveyance system has a remarkable meritorious effect in photographical treating such as developing, drying etc. for a long length printing paper which is much wider than the most popular 35 mm width roll film and has a tendency of losing its longitudinal rigidity as it gets wet with treating liquid, in that the conveyance system ensures increased rigidity against longitudinal warping which is naturally caused while the printing paper is subjected to developing treatment with the aid of guiding grooves of the guide rail which forms a passage through which the photographic printing paper is conveyed forward, without any danger of injuring the emulsion coated surface thereof, and in that the conveyance system ensures excellent developing and drying effects by means of the smooth flowing of treatment liquid and drying warm air owing to the arrangement of the bow-shaped longitudinally extending rods which are located along the guiding grooves at the middle position between said guiding grooves without any necessity for a number of conveyance rollers and other auxiliary guiding tools which are arranged throughout the passages in the conventional photographic treatment equipment or apparatus such as automatic developing apparatus or dryers for long length photosensitive materials which are often capable of causing unexpected troubles during the developing and drying operation, resulting in reduced operational efficiency.

Thus it can be concluded that the present invention provides photographic treatment equipment or apparatus for developing and drying long length photosensitive materials, which is capable of satisfactorily meeting the requirements which have been proposed upon the manufacturing industry of such photographic treatment equipment and apparatus by their users.

What is claimed is:

1. A conveyance system adapted for conveying a long length strip of photographic printing paper through photographic treatment equipment in which said photographic paper is subjected to a series of developing and associated steps after completion of exposure thereof, said conveyance system comprising:

(a) means for guiding both edges of said strip through said system, said guiding means including means defining guiding grooves which are adapted to extend along the length of said strip and to receive the edges of said strip;

(b) means for moving said strip through said system, said moving means including at least a first and second pair of cooperating rollers, the rollers of each pair being adapted to engage the edge of said strip between them and said first pair being adapted to engage one edge of said strip within said guiding grooves and said second pair being adapted to engage the other edge of said strip within said guiding grooves, and (c) means for engaging a face of said strip along at least a substantial portion along said length of said strip, said engaging means being adapted to increase the rigidity against warping of said strip by bending said strip into the cross sectional form of an arch extending between said guiding grooves.

2. The conveyance system of claim 1, wherein said means defining guiding grooves includes sheet metal which has been bent to form a V-shaped cross-section for said grooves, said guiding means also including a sheet metal portion for connecting the V-shaped grooves together, a large part of said portion being cut away and the remaining part of said portion being adapted to mount said guiding grooves so that the V-shaped grooves are arranged to face each other as they extend along the length of said strip.

3. The conveyance system of claim 1, wherein said treatment equipment has at least two chambers defined by vertical side wall means, and said means defining guiding grooves are arranged parallel to said side wall means.

4. The conveyance system of claim 1, wherein said means for guiding both edges of said strip includes means for guiding said strip in a U-shaped turn of direction, said last-named means including at least a first and second pair of cooperating rollers, the rollers of each pair being adapted to engage the edge of said strip between them.

5. The conveyance system of claim 1, wherein said means for engaging the face of said strip is configured in the form of a bow in the vicinity of its ends so that the travelling strip is gradually subjected to bending in the vicinity of one portion thereof while it is gradually released from bending in the vicinity of another portion thereof.

6. The conveyance system of claim 1, wherein said means for engaging the face of said strip comprises a vertically extending bow-shaped rod.

* * * * *